United States Patent [19]

Rhee

[11] 4,151,614

[45] May 1, 1979

[54] PROTECTIVE DEVICE FOR THE KNEE OR ELBOW

[76] Inventor: Jhoon Goo Rhee, 4068 Rosa Mora Court, Arlington, Va. 22207

[21] Appl. No.: 885,030

[22] Filed: Mar. 9, 1978

[51] Int. Cl.[2] ..... A41D 13/00

[52] U.S. Cl. ..... 2/24

[58] Field of Search ..... 2/2, 24, 16

[56] References Cited

U.S. PATENT DOCUMENTS

| | | | |
|---|---|---|---|
| 1,862,303 | 6/1932 | Glahe | 2/24 |
| 2,550,461 | 4/1951 | Fick | 2/16 |
| 2,603,786 | 7/1952 | Haines | 2/24 |
| 2,626,394 | 1/1953 | Davis | 2/24 |
| 3,458,867 | 8/1969 | Moore et al. | 2/16 |

*Primary Examiner*—Werner H. Schroeder
*Assistant Examiner*—Doris L. Troutman
*Attorney, Agent, or Firm*—James C. Wray

[57] ABSTRACT

The invention relates to a protective device adapted to protect the elbow or knee of a person while engaging in various sports and work. The device is constructed from a resilient energy-absorbing material such as plastic foam and comprises a generally rectangular planar member which can be cut or stamped from a sheet of plastic foam. One side of the planar member comprises a flap member adapted to be flexed together with corner ends of the side, and held together by a flexible cord to form a cradle section adapted to cradle the knee or elbow when worn and secured thereon by a strap member.

3 Claims, 4 Drawing Figures

PROTECTIVE DEVICE FOR THE KNEE OR ELBOW

BACKGROUND OF THE INVENTION

This invention relates to a protective device adapted to be worn on a person's elbow or knee for protection thereto while engaging in various types of work and sports. Particularly, in the sport of skateboarding injuries can occur to the elbows and knees when a person loses one's balance, slips off the skateboard, or the skateboard slips out from under the person, etc. When such happens, the person falls and attempts to break his fall by extending his arms and in so doing can land on his elbows causing injuries thereto. Similarly, one can fall on his knees causing injuries thereto. The protective devices are also useful in other sports such as basketball, soccer, hockey, etc.

The protective devices of the invention are also useful to a person doing various types of work wherein one must rest his knees and/or elbows on a surface, such as in scrubbing floors, laying carpeting, etc.

Although there are various known protective devices available for the elbow and knees, the protective device of this invention can be manufactured very inexpensively and has unique protective features.

SUMMARY OF THE INVENTION

It is an object of this invention to provide a novel protective unitary device for a person's elbow and/or knee to be worn thereon while engaging in various types of work and sports.

Another object of this invention is to provide a novel protective device for the elbow or knee of a person of simplified construction, comprising a resilient energy-absorbing plastic foam material which is relatively inexpensive.

A further object of the invention is to provide a device for wearing on a person's knee and/or elbow which protects against injury and cushions when used in various types of work and sports.

The protective device comprises a generally rectangular member constructed of a plastic foam material which is resilient and energy-absorbent. At the midsection of one side of the member a flap member containing holes is disposed, and at each end corner of the side there is a small hole and a larger hole containing a tongue member. A pair of spaced, elongated, parallel slots are disposed within the member adapted to have a strap member passed therethrough, which retain the device around the elbow or knee.

DETAILED DESCRIPTION OF THE INVENTION

Figure 1:
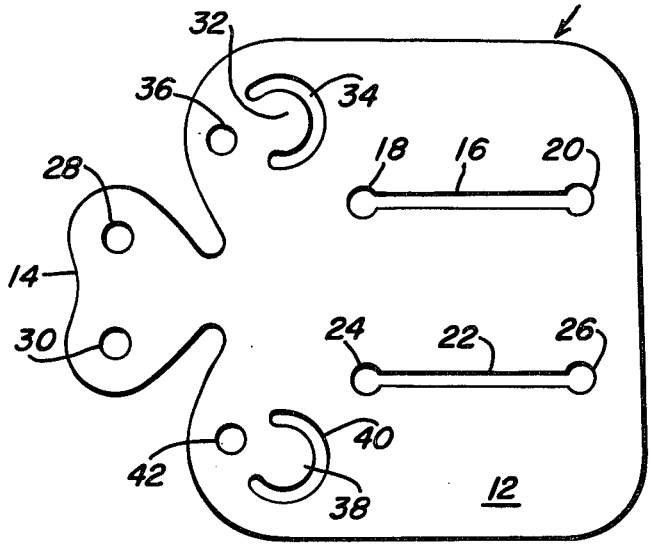
FIG. 1 is a top plan view of a development member comprising the protective device of the invention.
Figure 2:
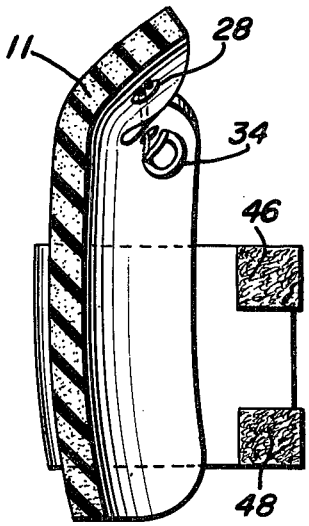
FIG. 2 is a longitudinal sectional view of the member of FIG. 1 as formed into the protective device of the invention.

The protective device of the invention is formed from a unitary development member generally designated by the numeral 10 in FIG. 1. Member 10 has planar surfaces 12 and can be inexpensively produced by stamping or cutting from a sheet of resilient energy-absorbing, plastic foam material 11. There are available today, various plastic foam materials in sheet form which are tear-resistant, resilient and capable of absorbing energy. These plastic foam sheet materials can be formed from polystyrene, polyurethane, rubber foams and the like. For example, on the market today, there are various closed cell, unicellular, plastic foam materials formed of many tiny closed cells filled with a gas such as nitrogen. These materials are very light, have very good strength and high shock absorbency and have a generally smooth surface. The materials can be used by themselves or they can be vinyl coated for additional strength by dipping, spraying or brushing. An example of these unicellular plastic materials is "ENSOLITE" (registered trademark of Uniroyal Corporation) which is a blend of nitrile rubber and polyvinylchloride.

Member 10 is a generally rectangular planar member stamped or cut from a sheet of the plastic foam material as described above. One side of the rectangular member comprises a flap member 14 extending from the midsection of the side having a pair of holes 28 and 30. At one end corner of the flap member side, there is a small hole 36 and a larger hole 34 containing a tongue member 32 extending therein providing a crescent slot. Similarly, the opposite end corner comprises hole 42, and hole 40 with tongue member 38. Within the side of the planar member, there is provided a pair of elongated substantially parallel slots 16 and 22. Each slot terminates at each end with holes, such as 18 and 20 for slot 16, and holes 24 and 26 for slot 22.

Member 10 is formed into the protective device by lacing one end of a continuous, flexible cord, string or lace 54 through holes 28 and 30, passing each end of the cord through holes 36 and 42, respectively, and looping each end over tongues 32 and 38, respectively. In so doing, the flap member 14 and corner ends of the member 10 are flexed upwardly together to form a cradle section. A strap member 44 containing securing means such as Velcro pieces 46, 48 at one end and 50, 52 at the other end, is threaded through slots 16 and 22. The purpose of holes 18, 20, 24 and 26 in the ends of the slots is to aid in preventing the ends of the slots from tearing.

Figure 3:
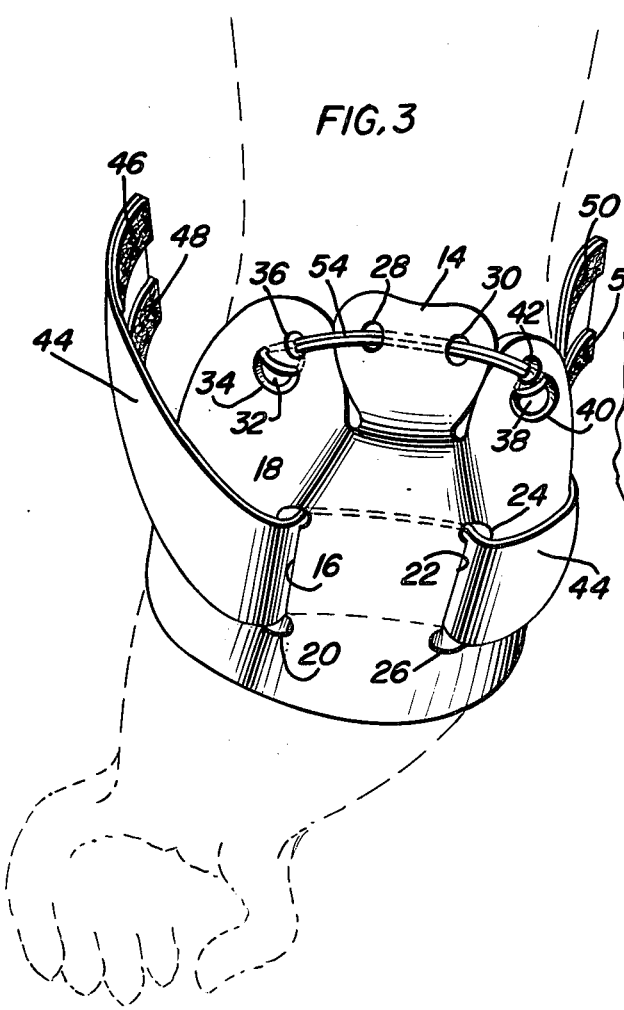
FIG. 3 is a perspective view of the protective device of the invention as worn by a person on the elbow.

The protective device can be worn on either the knee or the elbow. As shown in FIG. 3, the device is worn on the outside of the elbow with the elbow cradled in the cradle section of the device. Flap member 14 is disposed slightly above the elbow and the end corners around the sides of the elbow. The strap 44 is secured around the inside of the lower arm by securing together the Velcro pieces and thereby the device is retained on the elbow. As worn, the arm can be easily flexed at the elbow without any binding occurring between the device, the elbow and the upper and lower arms, because during flexing of the arm, flap 14 and the end corners are free to flex upon flexing of the flexible cord.

Figure 4:
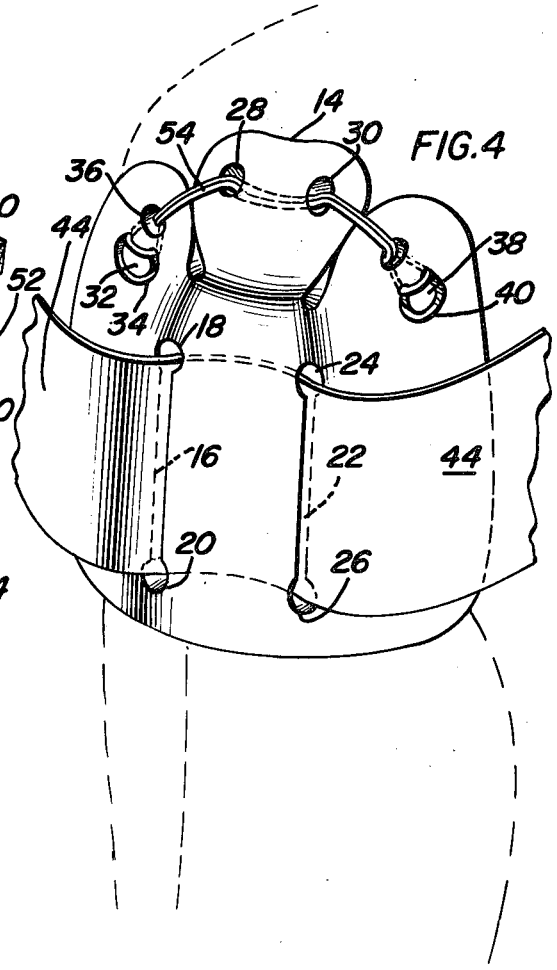
FIG. 4 is a perspective view of the protective device of the invention as worn by a person on the knee.

Similarly, the device can be worn on the knee as shown in FIG. 4. As worn on the knee, the flap 14 extends slightly above the knee and the end corners around the sides of the knee. Strap 44 is secured around the inside of the leg. As worn, the knee can be easily flexed without any binding occurring between the device, the knee and the leg or thigh, because during flexing of the knee, flap 14 and the end corners are free to flex upon flexing of the flexible cord.

As worn and in use when engaging in sports or during various types of work, the device protects the elbow or knee against accidental falls or contact with hard surfaces, while not restricting normal movement of the arm or leg.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A flexible, unitary device formed from a planar sheet of resilient, energy-absorbing plastic foam material comprising a generally rectangular member having a pair of elongated slots; one side of said rectangular member comprising a flap member extending therefrom containing a pair of holes; said flap member side comprising a small hole at each corner end, and a larger hole containing a tongue member therein; a flexible cord member laced through said holes of said flap member, through each of said small holes, and around each of said tongue members thereby forming a cradle section in said device; and strap members passing through said slots for securing said device around a knee or elbow of a person.

2. The device of claim 1 wherein said plastic foam material is a unicellular, closed cell material.

3. The device of claim 1 wherein said plastic foam material has a plastic coating on its surface.

* * * * *